United States Patent [19]

Sandor

[11] Patent Number: 4,691,980

[45] Date of Patent: Sep. 8, 1987

[54] QUICK DISCONNECT BATTERY TERMINAL

[76] Inventor: Jules A. Sandor, 12012 Bambi Pl., Granada Hills, Calif. 91344

[21] Appl. No.: 896,728

[22] Filed: Aug. 15, 1986

[51] Int. Cl.[4] ..... H01R 11/26

[52] U.S. Cl. ..... 439/476; 439/278; 439/726; 439/755

[58] Field of Search ..... 339/231, 232, 237, 263 B

[56] References Cited

U.S. PATENT DOCUMENTS 3,663,927 5/1972 Bruner ..... 339/232

3,775,730 11/1973 Rowls et al. ..... 339/231

*Primary Examiner*—Gil Weidenfeld

*Assistant Examiner*—Paula A. Austin

*Attorney, Agent, or Firm*—Sanford Astor

[57] ABSTRACT

This invention relates to a QUICK DISCONNECT BATTERY TERMINAL, particularly adapted for a battery with side terminals wherein each terminal contains a threaded socket which receives a battery terminal bolt, the bolt having fixedly attached around it a knurled or easy finger grip handle. The bolt comprising a plurality of flanges providing a recess and flange for engagement of the electrically conductive contact element of the battery cable, a flange for engagement of the cable cap, and a second recess for use with any working element such as a battery charger or tester.

9 Claims, 5 Drawing Figures

QUICK DISCONNECT BATTERY TERMINAL

BACKGROUND OF THE INVENTION

Electric storage batteries especially lead acid atorage batteries for automobiles are well known. Specifically, there are known to be in existence side terminal batteries with cable connectors which shield the electrical junction between the terminal and connector from environmental corrosive attack. These side terminal batteries, because of the location of the terminal and cable connector, isolate and protect the electrical junction between the terminal and the connector from the primary places of corrosive attack. A battery of this type is described in U.S. Pat. No. 3,775,730 issued to General Motors Corporation. A serious problem with this type of battery is that the battery terminal itself comprises a small bolt which, if it must be removed from the battery, is extremely difficult to remove and, in addition, there is extreme difficulty in quickly disconnecting the battery if it is necessary to do so while working on the car or for various other reasons. This is because the end of the battery terminal is so small it requires a special socket wrench to remove it and if there is any deterioration of the bolt, it could be extremely difficult to remove. For this reason, it becomes very difficult in the battery thus described to quickly disconnect the battery.

OBJECTS OF THE INVENTION

It is an object of the present invention to provide a quick disconnect battery terminal for those batteries which utilize a threaded bolt for the terminal.

It is a further objection of the invention to provide a simple and easy battery terminal which can be tightened by hand and taken off quickly and easily without the use of tools.

DESCRIPTION OF THE INVENTION

These objects, as well as other objects, will be obvious from the description of the attached drawings in which, FIG. 1 shows a battery utilizing the device of the present invention;

Figure 1:
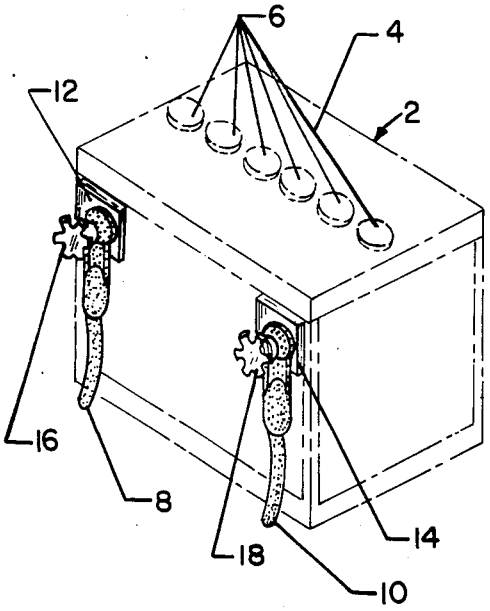

Referring now to the drawings, there is shown a battery 2 having side walls 4 and a plurality of battery terminals 6. Battery cables 8 and 10 are attached to the positive and negative terminals 12 and 14 of the battery 2. The cables 8 and 10 are connected by the quick disconnect battery terminals 16 and 18.

Figure 2:
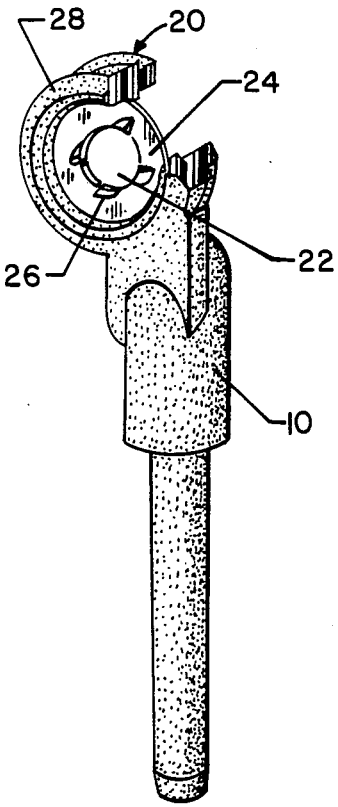
FIG. 2 shows the battery connector cable.
Figure 3:
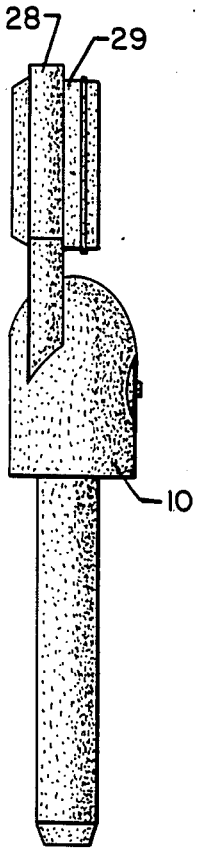
FIG. 3 is a side view of the cable.

Referring now to FIG. 2 and FIG. 3, there is shown an enlarged view of the end 20 of a typical standard battery cable 10. The end of the battery cable 20 has an aperture 22 through which the battery terminal can extend. An electrically conductive contact element 24 typically has locking tabs 26 extending into the aperture 22. These locking tabs 26 normally loosely engage a recess in the terminal to prevent the terminal from being separated from the cable connector 20.

An annular cap 28 holds the contact element 24 and in addition has a recess in the cap projection 29 which engages a flange of the terminal bolt.

Figure 5:
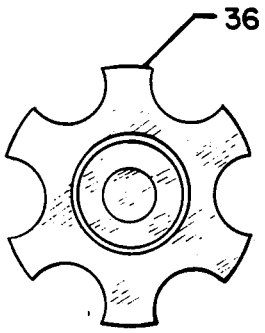
FIG. 5 is an end view of the handle of the present invention.
Figure 4:
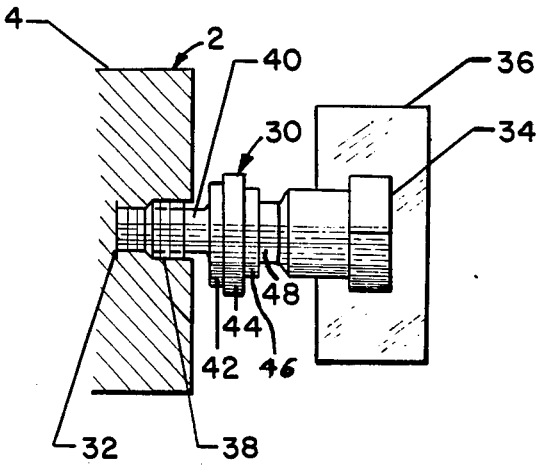
FIG. 4 is a cross-sectional view showing the quick disconnect battery terminal of the present invention.

Referring now to FIGS. 4 and 5, there is shown the bolt 30 which comprises the battery terminal and fits into a threaded socket 32 of the battery 2.

The bolt 30 has a head 34 around which is fixedly attached a handle 36 which is designed to be easily grasped by the human hand so that it can be easily tightened and loosened by hand. The handle 36 is fixedly attached to the head 34 of the the bolt 30, usually by casting the handle 36 directly onto the bolt 30 as when plastic is used. The handle 36 can be made of other nonconductive materials and is knurled or otherwise shaped to provide easy gripping. The handles 36 can be color coded, red for the positive side and blue for the negative side, so that the operator of the automobile has an easy time determining which is the positive and negative terminal.

The threaded end 38 of the bolt 30 threadably attaches into the socket 32.

The battery terminal bolt 30 of this invention comprises a first flange 42, a second flange 44 and a third flange 46 which define a recess 40 between the first flange 42 and the battery wall 4. A second recess 48 is defined between the third flange 46 and the head 34 or handle 36 of the battery terminal bolt 30. The first recess 40 provides the location for the electrically conductive contact element 24 so that tightening down of the bolt 30 makes a firm electrical connection between element 24 and the first flange 42.

The recess in the end 29 of cable cap 28 engages the second flange 44. The resiliant nature of the elastomeric material comprising the cap 28 deforms around the flange 44 to provide a seal. Recess 48 is available for connection of any working element such as a battery charger or tester.

The bolt 30 with handle 36 fits into standard side terminal batteries now in use without any change or modification to the standard battery or battery cable.

Having thus described the invention, it is requested that the scope of the invention be defined only by the attached claims.

I claim:

1. A battery terminal for a battery, cable combination comprising:

a bolt including a noncircular head portion with a first diameter and a body portion having a diameter less than said first diameter and having a longitudinal axis, and a handle molded onto said head portion and onto a part of said body portion so as to preclude movement of said handle along said longitudinal axis.

2. The device of claim 1 wherein the bolt also comprises a plurality of flanges.

3. The device of claim 1 wherein the bolt also comprises three flanges, the first flange defining a recess between the battery and the first flange, and the third flange defining a recess between the handle and the third flange.

4. The device of claim 1 wherein the handle comprises a nonconductive material.

5. The device of claim 4 wherein the handle is shaped to provide easy hand grasping.

6. A battery terminal for a battery having a threaded terminal, and a cable combination comprising:

a bolt including a noncircular head portion with a first diameter and a body portion having a diameter less than said first diameter, and having a foot portion and a longitudinal axis, said foot portion being threaded so as to threadably engage said threaded terminal, and said body portion having a plurality of flanges, said flanges providing a recess and flange for engagement of said cable; and a handle molded onto said head portion and onto a part of said body portion so as to preclude movement of said handle along said longitudinal axis.

7. The device of claim 6 in which the bolt comprises three flanges, the first flange defining a recess between the battery and the first flange, the third flange providing a recess between the handle and the third flange, and the second flange providing means for engagement of the battery cable.

8. The device of claim 6 in which the handle comprises a nonconductive material.

9. The device of claim 8 wherein the handle is shaped to provide easy hand grasping.

* * * * *